US007520716B2

(12) United States Patent
Tacconelli et al.

(10) Patent No.: US 7,520,716 B2
(45) Date of Patent: Apr. 21, 2009

(54) VANE SYSTEM EQUIPPED WITH A GUIDING MECHANISM FOR CENTRIFUGAL COMPRESSOR

(75) Inventors: Remo Tacconelli, Ponsacco (IT); Stefano Mantellassi, Lamporrecchio (IT)

(73) Assignee: Nuovo Pignone Holding S.p.A., Florence (IT)

( * ) Notice: Subject to any disclaimer, the term of this patent is extended or adjusted under 35 U.S.C. 154(b) by 401 days.

(21) Appl. No.: 10/596,898

(22) PCT Filed: Dec. 22, 2004

(86) PCT No.: PCT/EP2004/014775

§ 371 (c)(1),
(2), (4) Date: Jun. 28, 2006

(87) PCT Pub. No.: WO2005/064168

PCT Pub. Date: Jul. 14, 2005

(65) Prior Publication Data

US 2007/0166149 A1 Jul. 19, 2007

(30) Foreign Application Priority Data

Dec. 29, 2003 (IT) ..... MI03A2608

(51) Int. Cl.
*F04D 29/56* (2006.01)

(52) U.S. Cl. ..... 415/148; 415/151; 415/160; 415/161; 415/211.1

(58) Field of Classification Search ..... 415/148, 415/151, 160, 161, 211.1
See application file for complete search history.

(56) References Cited

U.S. PATENT DOCUMENTS

| | | | | | |
|---|---|---|---|---|---|
| 2,860,827 | A | * | 11/1958 | Hans | 415/164 |
| 3,237,918 | A | * | 3/1966 | Le Bell et al. | 415/210.1 |
| 3,442,493 | A | | 5/1969 | Smith, Jr. | |
| 3,458,118 | A | * | 7/1969 | Follmer et al. | 415/149.4 |
| 3,799,694 | A | | 3/1974 | Duzan | |
| 3,990,809 | A | * | 11/1976 | Young et al. | 415/160 |
| 4,430,043 | A | * | 2/1984 | Knight et al. | 415/159 |
| 4,804,316 | A | * | 2/1989 | Fleury | 417/407 |
| 5,190,439 | A | * | 3/1993 | Das | 415/149.4 |
| 5,460,484 | A | | 10/1995 | Yagi et al. | |
| 6,994,518 | B2 | * | 2/2006 | Simon et al. | 415/147 |

FOREIGN PATENT DOCUMENTS

| | | |
|---|---|---|
| DE | 2502986 | 7/1976 |
| EP | 0072701 | 2/1983 |

* cited by examiner

*Primary Examiner*—Igor Kershteyn
(74) *Attorney, Agent, or Firm*—Global Patent Operation

(57) ABSTRACT

A vane system for a centrifugal compressor (10), comprising two rows (15, 20) of vanes (15', 20') installed in series inside a suction duct (14), the first row (15) of fixed vanes (15') being suitable for homogenizing the gas flow that passes through them and sending it to the second row (20) of adjustable vanes (20') equipped with a guiding mechanism comprising a mechanical system (30) suitable for varying the orientation of the vanes (20').

12 Claims, 7 Drawing Sheets

View from "B"

Section D-D 50
51
52
53
54
55
56

VANE SYSTEM EQUIPPED WITH A GUIDING MECHANISM FOR CENTRIFUGAL COMPRESSOR

BACKGROUND

1. Field

The present invention relates to a vane system equipped with a guiding mechanism, for a centrifugal compressor.

In particular, the invention relates to a vane system for a centrifugal compressor with a cylindrical box, equipped with a guiding system.

2. Brief Description of Related Developments

Among the numerous applications of centrifugal compressors, those which require the presence of adjustable vanes at the inlet of the compressor, also known with the acronym of IGV (Inlet Guide Vanes) are familiar.

Adjustable vanes (IGV) can be regulated/rotated in order to position them at a suitable angle with respect to the direction of the inlet fluid to be compressed.

The use of centrifugal compressors in industrial production and synthesis processes, is well known.

Among the various applications, those operating on two different streams inside the same compressor, such as, for example, in the synthesis of ammonia and methanol, are also known.

In the latter plants, a two-phase compressor is used, wherein the first phase consists of reaction reintegration and the second of reactor recycling.

The suction pressure and composition are different in the two streams.

The flexibility control of the plant is highly conditioned as, in this configuration, the reintegration and recycling phase are connected and there is no way of modifying the pressure ratio between the two phases, unless an anti-pumping system for both phases is installed.

In the plants according to the known art, the compressor for the synthesis of methanol, as in general, all compressors destined for synthesis process plants, are provided, in some cases, with a suction chamber equipped with adjustable vanes (IGV), whereas, in other cases, the performance control is effected by the regulation valve situated in the suction duct of the recycling phase.

The latter solution is considered obsolete and has various disadvantages, in particular with respect to efficiency and control.

SUMMARY

A general objective of the present invention is to overcome the above drawbacks relating to the lack of efficiency and control present in the plants according to the known art, by providing a vane system for centrifugal compressors (IGV) suitable for improving performance control and efficiency.

Another objective of the present invention is to allow a better handling of the plant, thanks to the separate running of the regeneration and recycling streams.

Yet another objective of the present invention is to allow different operative conditions of the machine.

The mechanism of the present invention advantageously avoids the installation of a costly regulation valve.

Moreover, the mechanism allows a high flexibility of the process reactor.

In addition, the recycling step is advantageously improved as far as efficiency is concerned.

These and other objectives and advantages, according to the present invention, are achieved by means of a vane system for a centrifugal compressor, equipped with a guiding mechanism, according to the exemplary embodiments described herein.

Further specific characteristics are present in the dependant claims.

The vane system for a centrifugal compressor according to the invention comprises two rows of vanes installed in series inside a suction duct, the first row of fixed vanes being suitable for homogenizing the gas flow passing through them and sending it to the second row equipped with a guiding mechanism comprising a mechanical system suitable for varying the orientation of the vanes of said second row.

BRIEF DESCRIPTION OF THE DRAWINGS

The characteristics and advantages of a vane system equipped with a guiding mechanism for a centrifugal compressor, according to the present invention, will appear more evident from the following illustrative and non-limiting description, referring to the enclosed schematic drawings, wherein.

DETAILED DESCRIPTION

Figure 1:
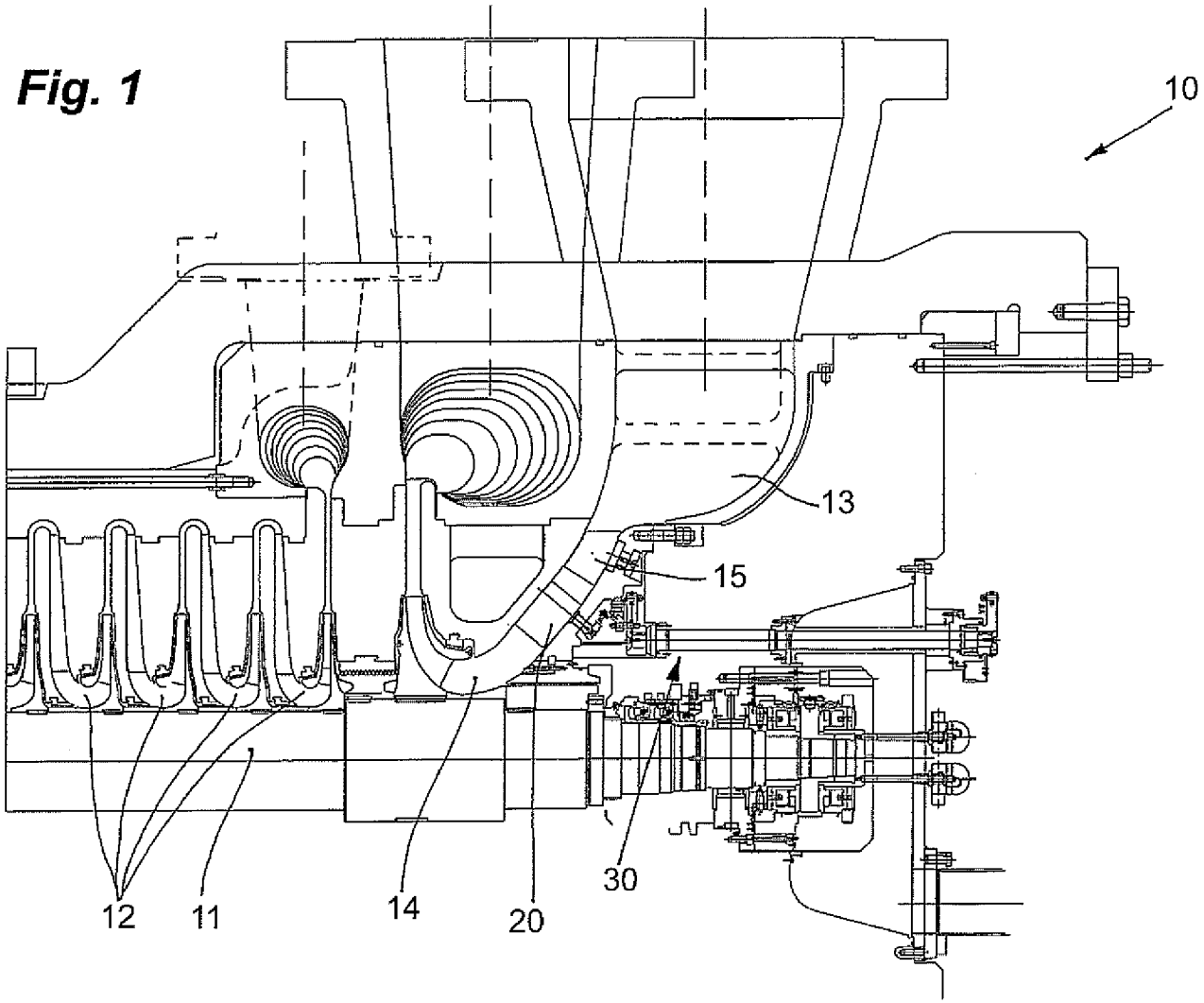
FIG. 1 is a partially sectional side schematic view of a compressor comprising the mechanism according to the invention.
Figures 2, 3:
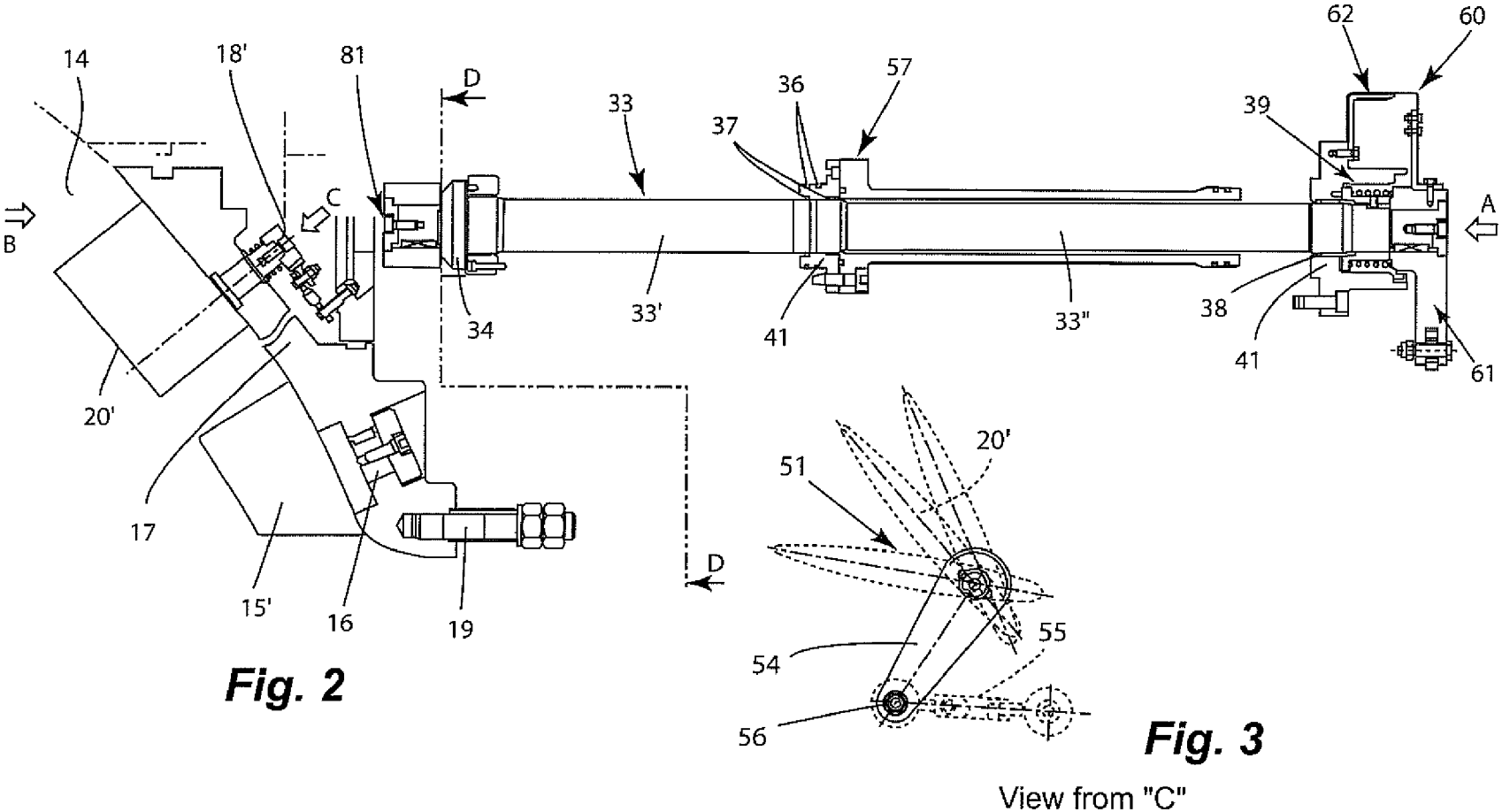
FIG. 2 shows the vane system according to the invention.
FIGS. 3 to 7 show different details of the system according to the invention.
Figure 4:
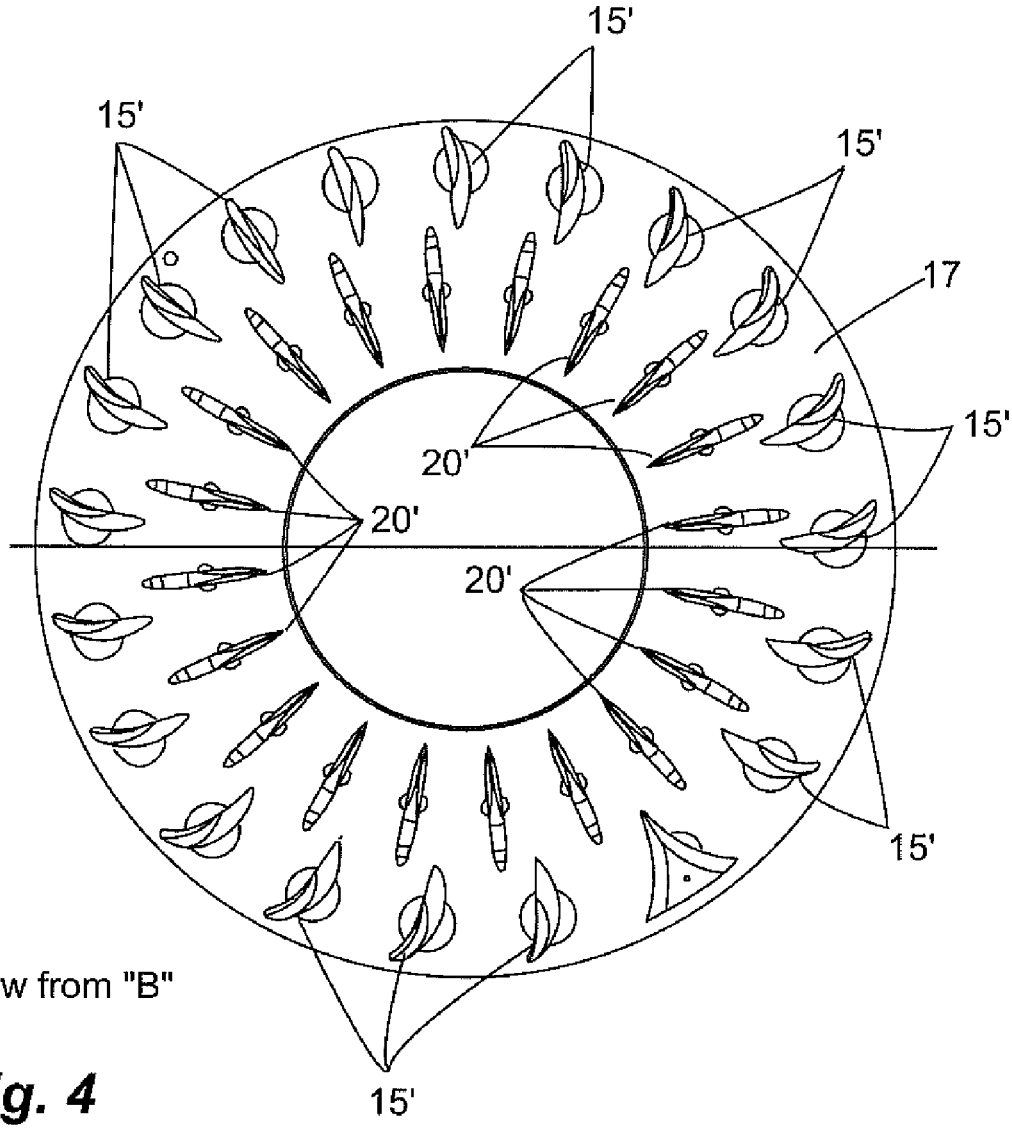
Figure 5:
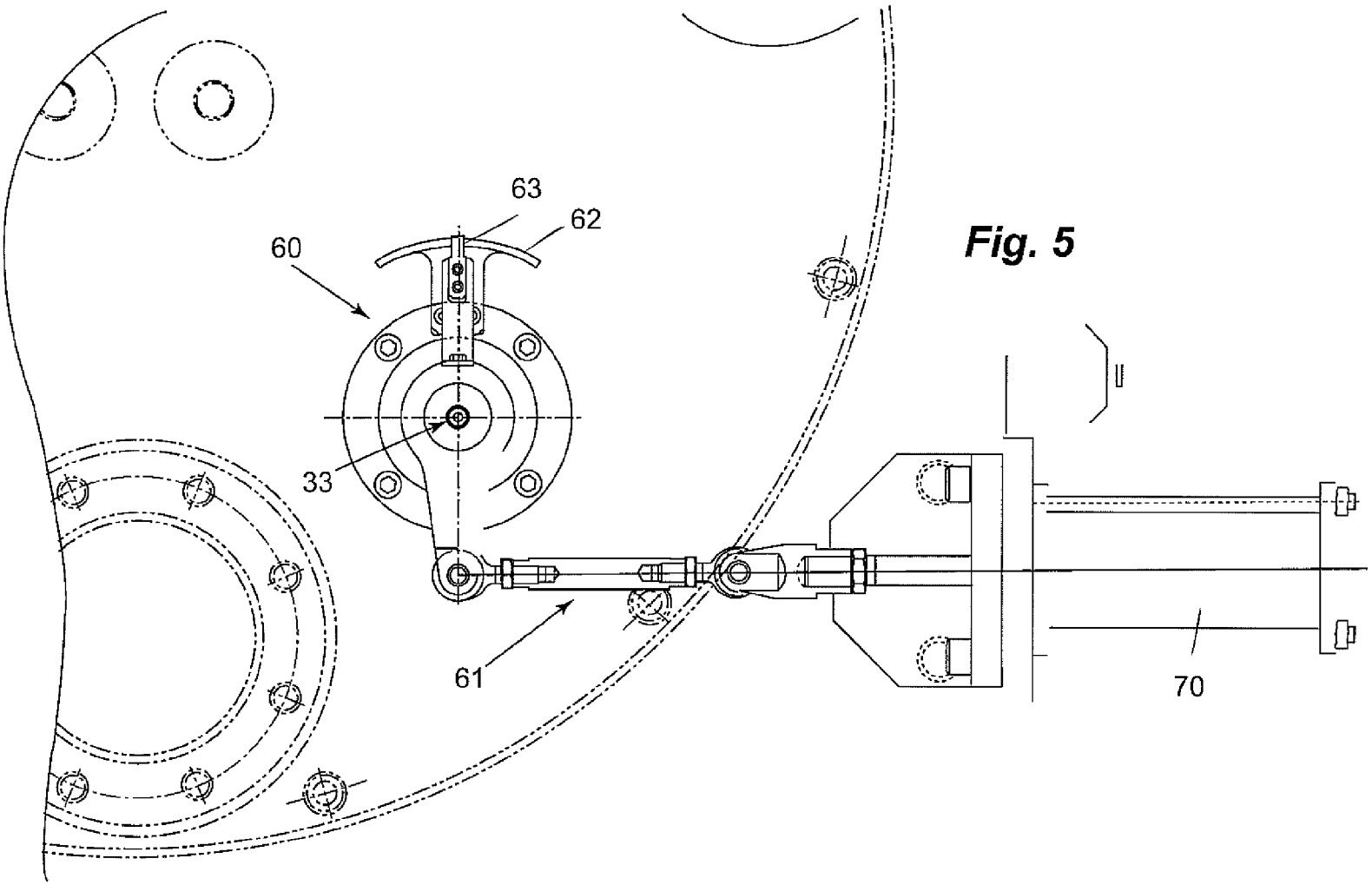

With reference to the figures, a centrifugal compressor 10 is equipped with a shaft 11, on which a Series of rotors 12, equipped with relative vanes, is installed.

A suction chamber 13, from which the gas is fed to the first stage of the compressor by means of the suction duct 14, is situated at the inlet of the compressor 10.

A vane system, comprising two different rows of vanes, is installed at the inlet of the suction duct 14, immediately after the suction chamber 13.

A first set 15 comprises fixed vanes 15', fixed to a vane-holder ring 17, by means of roots 16, situated in the conveyor, in turn connected to the terminal section 18' of the compressor box 18, by means of bolting with a stud 19.

A second set of vanes 20 is made up of adjustable vanes 20', also known with the Anglo-Saxon acronym IGV (Inlet Guide Vanes).

The adjustable vanes (IGV) can be regulated/rotated in order to position them at a suitable angle, with respect to the direction of the fluid entering the compressor, so as to vary the compressor inlet flow rate.

The second set 20 of adjustable vanes 20' receives a stream homogenized by the first set of fixed vanes 15, and is positioned downstream of said first set in the duct 14.

The second set 20 of adjustable vanes 20' is equipped with a mechanical system 30 suitable for regulating the orientation of the adjustable vanes 20' so as to vary the incidence angle on the rotor, thus modifying the flow gradient and exhaust pressure, regardless of the reintegration phase.

Said mechanical system is partially positioned inside the terminal section 18' of the compressor box 18 and passes through this to connect itself to an actuator 70, preferably of the pneumatic type, situated outside the box.

The mechanical system 30 envisages the connection of each adjustable vane 20' of the second set 20, to a shaft 33 by means of a first leverage 51 suitable for receiving the rotation effected by the actuator 70 to transmit it to the vanes 20'.

The kinematic chain of the mechanical system 30 for guiding the adjustable vanes 20' of the second set 20, therefore includes the connection of each adjustable vane 20' by means of its foot 50, produced in the form of a shaft, to the first leverage 51, in turn connected by means of the rotating ring pin 52, to a disk 53.

The disk 53 receives the rotation movement provided by the shaft 33 by means of a second leverage 81 connected to the opposite side of disk 53.

Figure 6:
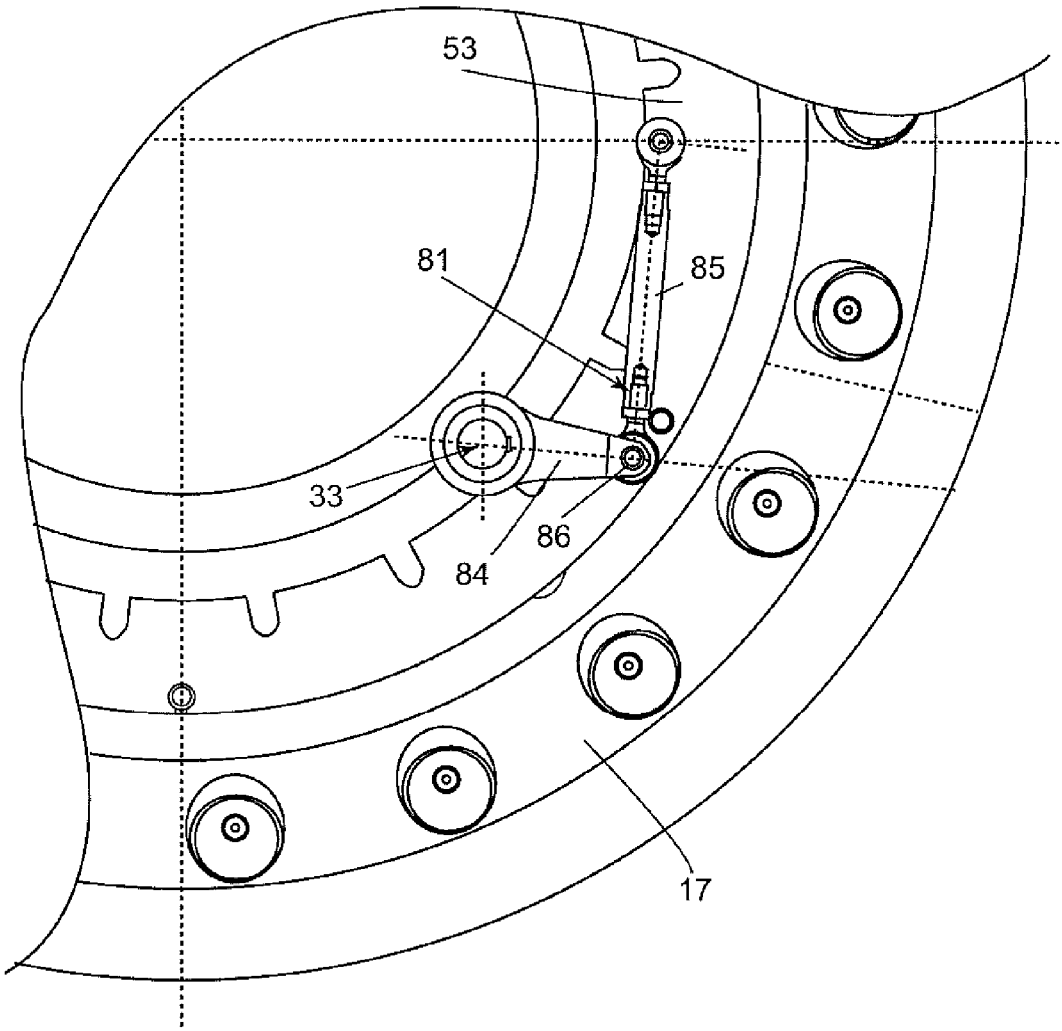
Figure 7:
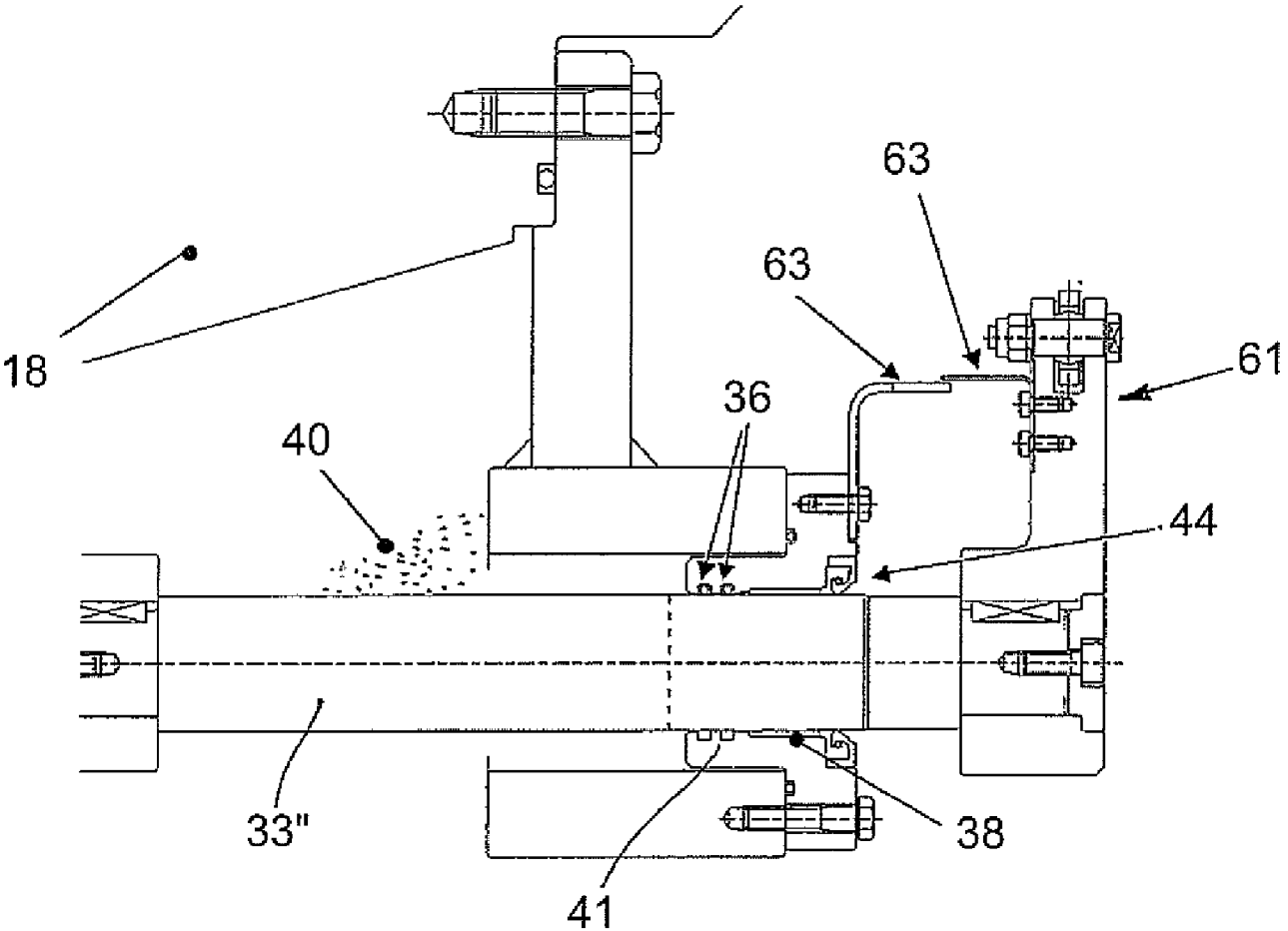
Figures 8, 9:
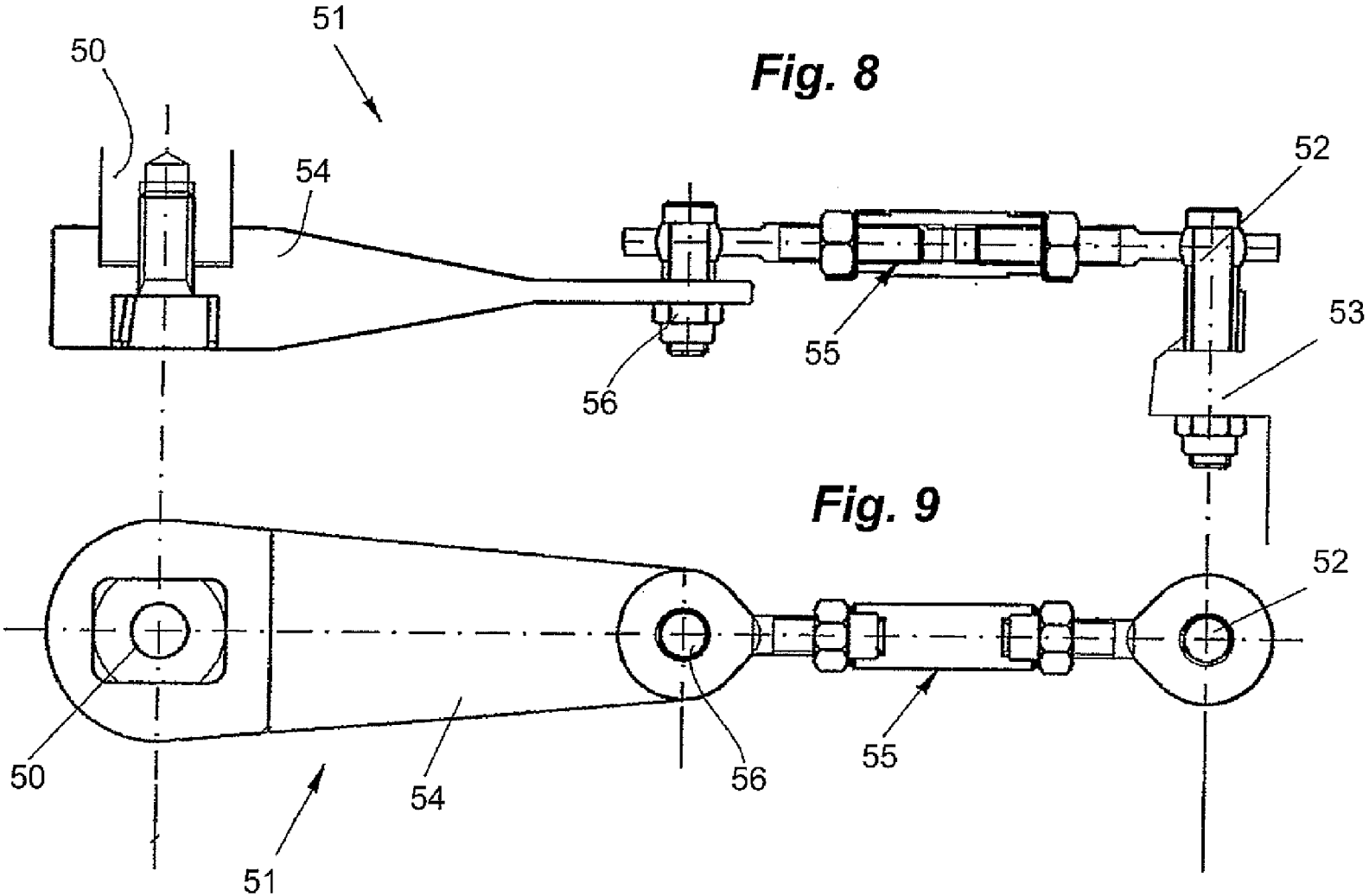
FIGS. 8 and 9 show respectively in elevation view and in plan view a double leverage of the mechanism of the system according to the invention.

With particular reference to FIGS. 8 and 9, these illustrate the first leverage 51, and with reference to FIG. 6, this shows the second leverage 81 applied to the disk.

The first leverage 51 comprises a lever 54 fixed at one end to said foot of the adjustable vane 20' and hinged at the other end to a tie rod 55 by means of rotating ring pin 56.

The tie rod 55 is, in turn, hinged to the disk 53, as already mentioned, in order to receive the rotational movement of the shaft 33.

In the same way, the second leverage 81 includes a lever 84 fixed at one end to said shaft 33 and hinged at the other end to a tie rod 85 by means of the rotating ring pin 86.

The tie rod 85 is, in turn, hinged to the disk 53, as already mentioned, in order to receive the rotational movement of the shaft 33.

The shaft 33, in contact with the tie rod 85, is equipped with a thrust rim 34 which rests on bushings 38 coated with antifriction treatment.

The shaft is advantageously divided into two portions, a first portion 33' towards the vanes, and a second portion 33" outwards, connected by means of the joint 57 to facilitate dismantling and maintenance.

A ring 41 is placed at the end of the first portion 33' of said shaft 33, close to the joint, equipped with Teflon washers 37, and a spring in order to retain the process gas inside the box 18.

A further ring 41, equipped with o-ring washers 36, is positioned downstream to retain the lubricant vapors 40 present.

Anti-extrusion rings, for example made of Teflon, and charged springs 37, again made of Teflon, are also present close to the end of the first portion 33' of the shaft 33.

The shaft is equipped with bushings coated with antifriction material 38 to allow easy rotation, and with at least one sealing ring 44 which serves to keep the dirty particles and sludge out of the box.

A spiral coil 39 envelops the shaft body to keep it in a stand-by position and rests on a retention body 35 which rubs against the shaft itself, with the interposition of antifriction bushings 38.

The end of the second portion 33" of the shaft 33 which protrudes outside the box 18 is connected to an actuation and control system 60 comprising the actuator 70 which transmits rotation upon command, a third leverage 61 substantially similar to the first and second leverage 51 and 81, and a reading system of the inclination angle of the vanes 20'.

The reading system is activated by means of the actuator which provides the shaft, and consequently the vanes, with a rotational movement, and the reading of the orientation for the vanes 20' is effected by means of a reference index 63 fixed to the leverage 61 and which cooperates with a graduated label 42 fixed, for example, to the ring 41.

In this way it is possible to control and impart the predefined rotation, both clockwise and anti-clockwise, to the vanes 20' of the second row of vanes 20, so as to optimize the efficiency of the stream to be compressed.

The invention claimed is:

1. A vane system for a centrifugal compressor (10), comprising two rows of vanes installed in series inside a suction duct, a first row of fixed vanes being suitable for homogenizing a gas flow passing through them and sending it to a second row of adjustable vanes, said second row being equipped with a guiding mechanism comprising a mechanical system suitable for varying an orientation of the vanes, the mechanical system including a connection of each adjustable vane of the second row to a shaft by a first leverage suitable for receiving a rotation imparted by an actuator, each adjustable vane being connected, through a respective foot produced in the form of a shaft, to the first leverage, in turn connected by a first rotating ring pin, to a disk which receives rotational movement induced by the shaft, and the first leverage comprises a lever fixed at one end to said foot of the adjustable vane and hinged at the other end to a tie rod by a second rotating ring pin.

2. The vane system according to claim 1, wherein said first row of fixed vanes is fixed by roots to a structure of the diffuser, in turn connected to a terminal portion a compressor box.

3. The vane system according to claim 1, wherein the second row of adjustable vanes equipped with the mechanical system, is activated by a pneumatic actuator, suitable for varying the orientation of the vanes so as to vary an incidence angle on a rotor, thus modifying a flow gradient and discharge pressure.

4. The vane system according to claim 1, wherein said tie rod is, in turn, hinged to the disk to receive the rotational movement of the shaft.

5. The vane system according to claim 4, wherein said shaft is connected to said disk by a second leverage.

6. The vane system according to claim 1, wherein said shaft is equipped with a thrust rim which rests on bushings coated with antifriction treatment.

7. The vane system according to claim 5, wherein said shaft is divided into two portions, a first portion towards the vanes, and a second portion outwards, connected by a joint.

8. The vane system according to claim 7, wherein a ring is positioned at the end of the first portion of said shaft, close to the joint, equipped with Teflon washers, energized with a spring to retain a process gas inside a compressor box, and a further ring, equipped with o-ring washers, is situated downstream, to retain the lubricant vapors.

9. The vane system according to claim 1, wherein the shaft is also equipped with at least one sealing ring which serves to keep dirty particles and sludge out of a compressor box.

10. The vane system according to claim 1, wherein there is also a spiral coil which envelops the shaft to keep it in a stand-by position, and which rests on a retention body which rubs against the shaft itself, with an interposition of antifriction bushings.

11. The vane system according to claim 7, wherein the end of the second portion of the shaft which protrudes outside a compressor box is connected to an actuation and control system comprising the actuator which transmits rotation upon command, a third leverage substantially similar to the first and the second leverages and a reading system of the inclination angle of the vanes.

12. The vane system according to claim 11, wherein the reading of the inclination angle of the vanes of the second row is effected by a reference index fixed to the third leverage and which cooperates with a graduated label fixed to the ring.

* * * * *